United States Patent [19]

Andres et al.

[11] Patent Number: 4,550,774

[45] Date of Patent: Nov. 5, 1985

[54] SURFACE HEATING BODY FOR VEHICLES

[75] Inventors: Rudolf Andres; Helmut Grantz, both of Sindelfingen; Wolf-Dietrich Muenzel, Ehningen; Wolfgang Odebrecht, Sindelfingen, all of Fed. Rep. of Germany

[73] Assignee: Daimler-Benz Aktiengesellschaft, Fed. Rep. of Germany

[21] Appl. No.: 462,776

[22] Filed: Feb. 1, 1983

[30] Foreign Application Priority Data

Feb. 2, 1982 [DE] Fed. Rep. of Germany ..... 3203369

[51] Int. Cl.[4] ..... F28D 15/00

[52] U.S. Cl. ..... 165/104.21; 165/104.14; 165/168; 165/41; 219/202; 219/341

[58] Field of Search ..... 165/104.14, 104.21, 165/104.26, 168; 126/433; 219/258, 202, 201, 341

[56] References Cited

U.S. PATENT DOCUMENTS

| | | | |
|---|---|---|---|
| 1,817,394 | 8/1931 | Pais | 165/104.21 |
| 1,884,612 | 10/1932 | Dinzl | 165/168 |
| 2,955,184 | 10/1960 | Grindrod | 165/168 |
| 3,651,861 | 3/1972 | Deuring | 165/104.26 |
| 3,651,865 | 3/1972 | Feldmanis | 165/104.26 X |
| 3,675,711 | 7/1972 | Billinski et al. | 219/201 |
| 3,853,112 | 12/1974 | Lazaridis et al. | 165/104.26 |

FOREIGN PATENT DOCUMENTS

| | | | |
|---|---|---|---|
| 152388 | 11/1980 | Japan | 165/104.33 |
| 130589 | 10/1981 | Japan | 165/104.21 |
| 1213644 | 11/1970 | United Kingdom | 219/341 |

*Primary Examiner*—Albert W. Davis, Jr.
*Attorney, Agent, or Firm*—Craig and Burns

[57] ABSTRACT

A surface heat-exchanger body for vehicles, aircrafts or ships, with an interconnected heat pipe-channel system which is hermetically closed and arranged distributed over an area; as a result of a separate line-shaped heat source which extends along the heat-exchanger body and which may be formed by a heating channel, a heating rod or the like, heat is supplied to the heat-exchanger body which is distributed and given off by the heat pipe-channel system to the adjoining space with a slight temperature drop inside of the heat-exchanger body; for a horizontal installation of the heat-exchanger body, intersecting or star-shaped channel sections are provided inside of the heat pipe-channel system which always return the condensate to the condensate collector independently of the direction of the resultant of gravity and inertia forces; the condensate collector may be constructed in the form of a closed annular line either concentrically on the inside of the surface heat-exchanger body or along the outer edge; to enhance the condensate return, the surface heat-exchanger body may be slightly arched, whereby the condensate collector must be placed at the geodetically lowest place.

18 Claims, 14 Drawing Figures

FIG. 1
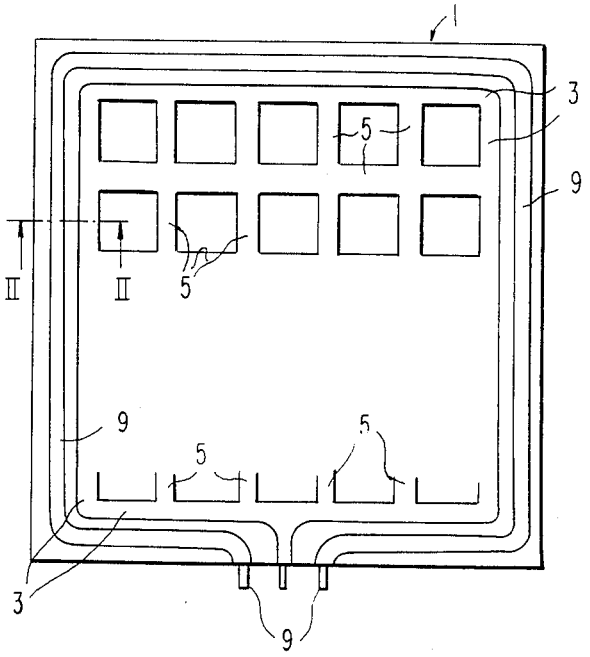
FIG. 2
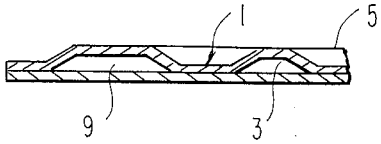
FIG. 4
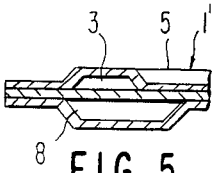
FIG. 5
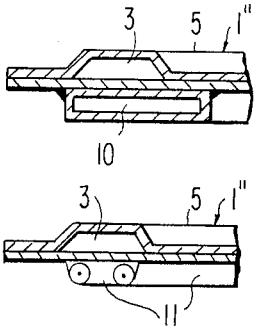
FIG. 6
FIG. 3
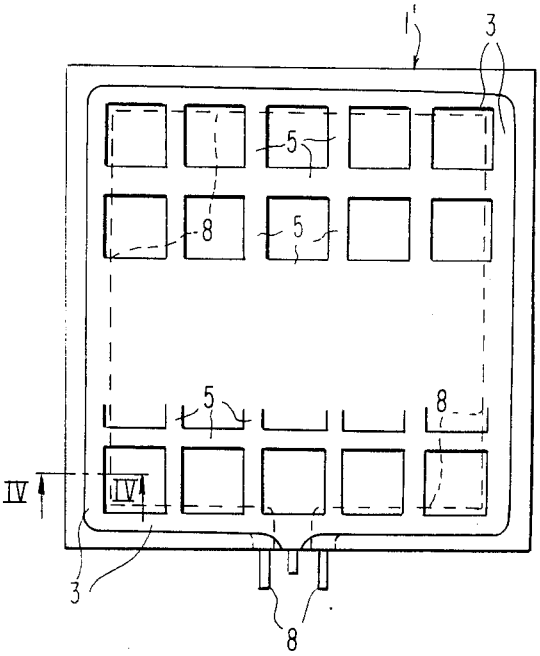

FIG. 7
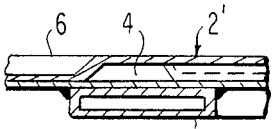
FIG. 9
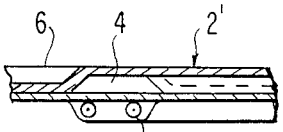
FIG. 10
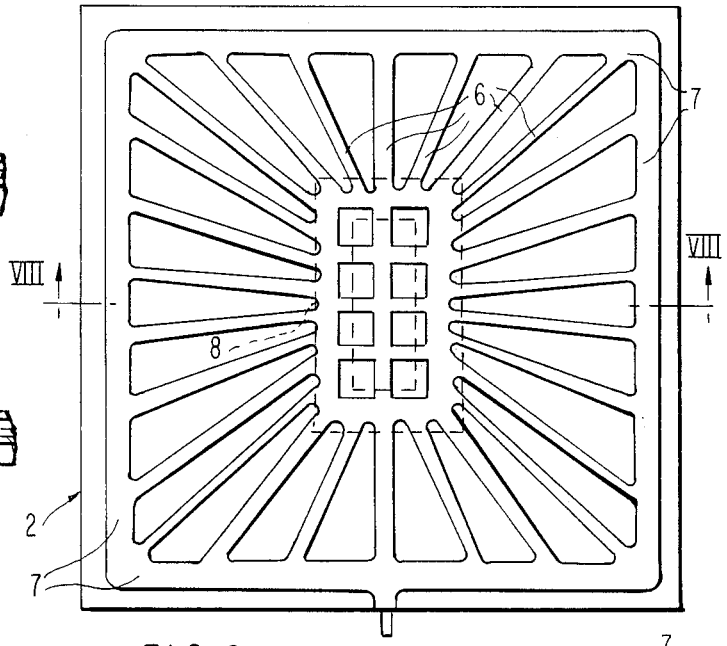
FIG. 8
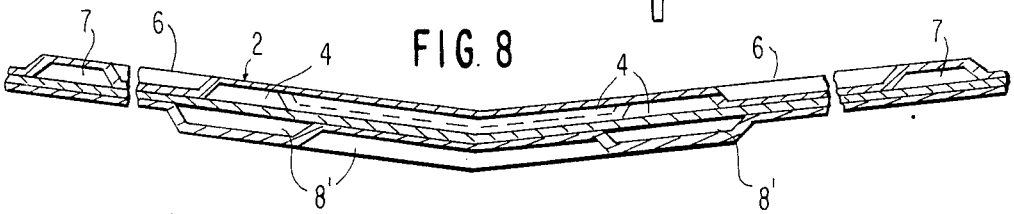
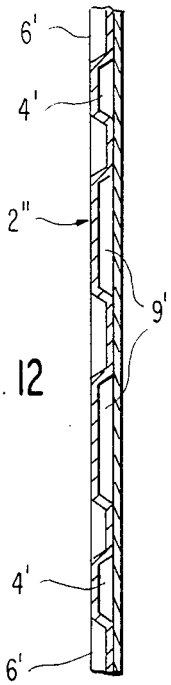
FIG. 12
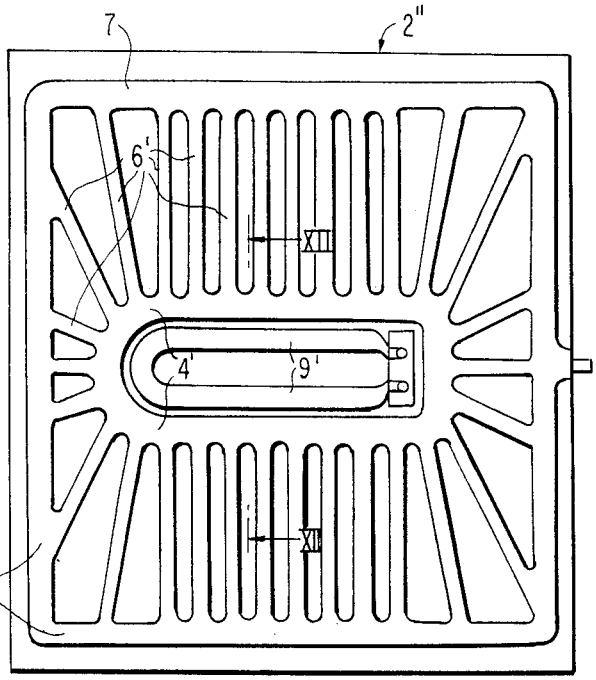
FIG. 11

SURFACE HEATING BODY FOR VEHICLES

The present invention relates to a surface heat-exchanger structure for vehicles as are described, for example, in the non-prepublished German Offenlegungsschrift No. 30 41 710. In addition to being applicable to vehicles, such types of surface heat-exchanger bodies are equally applicable also for aircrafts and ships.

The known area or surface heat-exchanger bodies are vertical in the installed position, whereby the heating rod, the heating channel or the like extends along the bottom edge thereof. The condensate forming within the heat pipe-channel system returns under the influence of gravity into the lower condensate collector from where it is again evaporated by external heat supply and is then able to expand in the interior of the heat pipe-channel system. Such area or surface heat-exchanger structures serve the purpose of distributing the heat from a heat source extending line-shaped by way of a larger area into the adjacent space.

It is the object of the present invention to so construct the area or surface heat-exchanger bodies that they are also suitable for a horizontal installation in movable objects such as motor vehicles, aircrafts or ships, in which one has to reckon with inclinations and acceleration, respectively, deceleration influences that last for relatively longer periods of time.

The underlying problems are solved according to the present invention in that the heat pipe-channel system includes mutually crossing or intersecting channels in at least two directions extending at an angle to one another and a circumferential ring channel as condensate collector which extends uninterruptedly within the area of the entire outer edge of the area heat-exchanger body, and in that the heating rod, heating channel or the like extends uninterruptedly along the entire circumference of the area heat-exchanger body. Owing to the circular-symmetrical arrangement of the condensate collector, on the one hand, and of the heat-transferring channel sections, on the other, on the inside of the heat pipe-channel system, the heat-exchanger structure of the present invention is independent of gravitational and inertia forces. It is assured thereby that condensate will always collect within the area of the heat supply by the heating rod, the heating channel or the like and is evaporated by the heat source.

These and other objects, features and advantages of the present invention will become more apparent from the following description when taken in connection with the accompanying drawing which shows, for purposes of illustration only, several embodiments in accordance with the present invention, and wherein:

FIG. 1 is a top plan view on a heat-exchanging body in accordance with the present invention having channel sections giving off heat which extend crosswise;

FIG. 2 is a partial cross-sectional view through the heat-exchanging body according to FIG. 1, taken along line II—II of FIG. 1;

FIG. 3 is a top plan view on a further embodiment of a heat-exchanging body in accordance with the present invention with channel sections giving off heat which are arranged crosswise;

FIG. 4 is a partial cross-sectional view, taken along line IV—IV of FIG. 3;

FIG. 5 is a partial cross-sectional view, similar to FIG. 4, through a modified embodiment of a heat-exchange body in accordance with the present invention similar to FIGS. 3 and 4 for the incorporation of a heating channel;

FIG. 6 is a partial cross-sectional view, similar to FIG. 4, through a modified embodiment of a heat-exchanging body in accordance with the present invention similar to FIGS. 3 and 4 for the incorporation of a heating rod;

FIG. 7 is a top plan view on a still further embodiment of a heat-exchanging body according to the present invention with channel sections giving off heat which are arranged star-shaped;

FIG. 8 is a cross-sectional view taken along line VIII—VIII of FIG. 7;

FIG. 9 is a partial cross-sectional view through a modified embodiment of a heat-exchanging body similar to FIGS. 7 and 8, within the area of the condensate collector and illustrating a different construction of the heating channel in accordance with the present invention;

FIG. 10 is a partial cross-sectional view, similar to FIG. 9, and illustrating a different construction of the heating rod in accordance with the present invention;

FIG. 11 is a top plan view on a still further modified embodiment of a heat-exchanging body in accordance with the present invention with channel sections arranged star-shaped; and FIG. 12 is a partial cross-sectional view taken along line XII—XII of FIG. 11.

Figure 13:
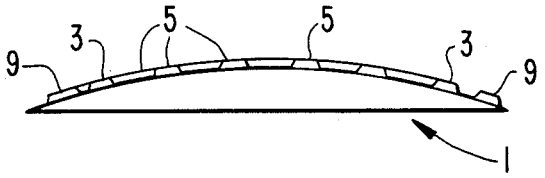
FIG. 13 is a cross-sectional view of a circular symmetrical arrangement of a condensate collector and heat transferring channel section in accordance with the invention.

Referring now to the drawing wherein like reference numerals are used throughout the various views to designate like parts, the area or surface heat-exchanging bodies illustrated in the various figures are constructed throughout as inflated multi-layered partial composite laminated bodies which in part are constructed two-layered and in part three-layered, utilizing conventional techniques known in the art. The embodiments illustrated in FIGS. 1 through 6 of area or surface heat-exchanging bodies generally designated by reference numerals 1, 1', respectively, 1'' include mutually crossing or intersecting channels 5 which terminate in an annular channel that extends circumferentially uninterruptedly within the area of the entire outer edge of the surface heating body as condensate collector 3. This heat pipe-channel system consisting of mutually crossing channels and of condensate collector is evacuated and is filled partially with a heat-carrier medium adapted to evaporate, respectively, condense, for example, with a cooling medium, and is subsequently hermetically closed off. The intersecting channels 5 extend in the illustrated embodiment at right angle to one another and parallel to the sides of the annular channel-shaped condensate collector 3 extending in the form of a square as viewed in top plan view. However, constructions are also feasible within the scope of the present invention, in which the intersecting channels are arranged in three different directions with a mutual angle of inclination of 60°. A further modified embodiment which is also quite feasible within the scope of the present invention could contain also intersecting channels extending at right angle to one another, which then extend parallel to the diagonals of the heat-exchanging body. In any case, it is assured by the intersecting channels, on the one hand, and by the condensate collector extending ring-shaped along the outer circumference, on the other, that the condensate which will form will run in every case toward some circumferential place of the condensate collector 3 independently of the direction of the resultant of gravitational force and inertia force influence and encounters thereat a partial section of the heat source.

In the embodiment illustrated in FIGS. 1 and 2, the surface heat-exchanging body 1 is constructed as two-layer inflated partial composite laminated body. With this construction, the heating channel 9 adapted to be traversed by heating water is arranged radially outside the ring-shaped condensate collector 3. The heat supply from the heating channel 9 to the condensate collector 3 takes place by way of the web-shaped section between the heating channel 9 and the condensate collector 3.

The embodiment of the surface heating body 1' illustrated in FIGS. 3 and 4 is constructed as inflated three-layer partial composite laminated body. Even though the material requirements are greater in that case, this modified embodiment offers the advantage that the heating channel 8 adapted to be traversed by the heating water is disposed with a wide surface to the ring-shaped condensate collector 3 and a considerably larger heat transfer surface exists between the two channels so that a heat transfer is possible with a lower temperature gradient and smaller heat loss. Additionally, the area requirements of the surface heat-exchanging body are smaller. Consequently, from an overall point of view, the same heat quantity, referred to the weight used in the surface heat-exchanger can be transmitted under certain circumstances notwithstanding a higher material use.

In FIGS. 5 and 6, still further modifications of the area heat-exchanging body according to FIGS. 3 and 4 are illustrated in which, however, the heat-exchanging body 1" is constructed as two-layered partial composite laminated body involving smaller material requirements. In the embodiment illustrated in FIG. 5, the heating channel 10 is brazed onto the flat bottom side of the heat-exchanging body 1" in a good heat conducting manner or is bonded thereto in such a manner by means of a good heat-conducting adhesive material. FIG. 6 illustrates a corresponding embodiment in which, however, an electric heating rod 11 is provided heat-conductingly within the area of the condensate collector 3. The heating rod may consist of heating coils that are embedded heat-conductingly in a heat-resistant rubber mat which, in its turn, is vulcanized heat-conductingly and heat-resistantly onto the flat bottom side of the surface heat-exchanging body 1".

Figure 14:
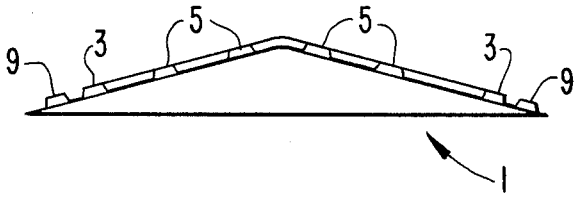
FIG. 14 is a cross-sectional view of a conical pyramidal-shaped heat-exchanging body in accordance with the invention.

For purposes of favoring the condensate return from the intersecting channels giving off heat to the condensate collector 3, provision may be made that the heat-exchanging body is curved hourglass-shaped or slightly pyramidally or conically shaped as shown in FIG. 14. In the installed position, the curvature is thereby to be provided upwardly in the gravitational direction so that the ring-shaped condensate collector comes to lie geodetically at the lowest place.

FIGS. 7 to 12 also illustrate surface heat-exchanging bodies generally designated by reference numerals 2, 2' and 2" constructed as inflated multilayered partial composite laminated bodies, in which the channel sections of the heat pipe-channel system which give off heat are constructed as star-shaped channels 6, respectively, 6'. More particularly, with these surface heat-exchanging bodies, the condensate collector 4, respectively, 4' is arranged approximately centrally inside of the heat-exchanging body and the star channels 6, respectively, 6' extend in all directions. To favor pressure equalization between the individual star channels, the latter are all interconnected at their radially outermost end by an annular channel 7 also belonging to the heat pipe-channel system. The heat supply takes place in this case also within the area of the condensate collector so that the heating channel, heating rod or the like is also arranged centrally inside of the surface heat-exchanging body.

The heat-exchanging body 2 illustrated in FIGS. 7 and 8 is constructed as three-layered partial composite laminated body. The condensate collector 4 is constructed as small cross-channel system with a circumferential channel extending rectangularly along the outer circumference. However, it is also feasible within the scope of the present invention to provide a disk-shaped hollow space as condensate collector, in which small contact places are provided from a surface point of view exclusively for the support of the two oppositely disposed walls. The crossing channels inside of the condensate collector 4 serve the purpose of a safe and rapid condensate exchange during a change of the gravitational force direction, respectively, inertia force direction. The heating channel 8' formed by the third layer of the three-layered partial composite laminated body extends ring-shaped rectanglarly along the outer annular line of the condensate collector 4 and is in operative connection therewith over a wide area and in a good heat-conducting manner.

FIGS. 9 and 10 illustrate area or surface heat-exchanging bodies 2' which are constructed as two-layered partial composite laminated bodies and which are therefore more light-weight than the heat-exchanging body according to FIGS. 7 and 8. As to the rest, however, the heat-exchanging bodies according to FIGS. 9 and 10 correspond to the heat-exchanging body according to FIGS. 7 and 8, insofar as concerns the shape of the heat pipe-channel system. In the surface heat-exchanging body 2' according to FIG. 9, a separate heating channel 10' constructed as rectangular pipe is connected over a wide area and in a good heat-conducting manner with the ring channel of the condensate collector 4. The modification illustrated in FIG. 10 provides therefor a heating rod 11', similar to the embodiment in FIG. 6.

The surface heat-exchanging body 2" illustrated in FIGS. 11 and 12 is constructed as two-layered partial composite laminated body, in which the condensate collector 4' is formed exclusively by an annular channel. The heating channel 9' which is arranged or constructed U-shaped, is formed on the inside of the area enclosed by this ring channel—formed by the same two layers of the two-layered partial composite laminated body; the heating channel 9' gives off its heat to the condensate collector 4' constructed as annular channel by way of a narrow intermediate web. This modified construction offers the advantage of a rational manufacture of the two channel systems with simultaneous relatively small material requirements.

FIG. 13 shows a cross-sectional view of a circular-symmetrical arrangement of condensate collector and heat transferring channel, a form which can be taken by the invention.

In order to favor the centripetal return of the condensate to the condensate collector, an hourglass-shaped, respectively, a slightly pyramidally or conically shaped curvature of the area or surface heat-exchanging body may be provided in the embodiment according to FIGS. 7–12, whereby, however, in these embodiments, the curvature must point downwardly so that the condensate collector 4, respectively, 4' also comes to lie at the geodetically lowest place. Though the curvature is more important with these embodiments than with the embodiments according to FIGS. 1 through 6, the surface heat-exchanging bodies with a centrally arranged condensate collector offer the advantage that the area to be heated is smaller and the condensate can be collected independently of direction in a relatively small area.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A surface heat-exchaging body for vehicular use comprising a hermetically closed interconnected heat pipe-channel system distributed over an area and including condensate collector means and heat source means heat-conductingly coupled to said heat pipe-channel system and extending at least along a part thereof, the heat-pipe-channel system comprising mutually interconnected channel means extending in at least two directions at an angle to one another configured as a matrix, the interconnected channel means lead into a condensate collector means in said at least two directions, and the heat source means being in heat-transferring relationship with the condensate collector means formed only as an annular channel extending substantially uninterruptedly at one of a center and an outer edge area of the interconnected channel means of said heat pipe-channel system.

2. A heat-exchanging body according to claim 1, wherein the condensate collector means is arranged approximately centrally within the heat-exchanging body, the channel means of the heat pipe-channel system extend star-shaped away from the condensate collector means in all directions and in that the heat source means extends over the approximately centrally arranged condensate collector means.

3. A heat-exchanging body according to claim 2, wherein the heat source means extends U-shaped over the approximately centrally arranged condensate collector means.

4. A heat-exchanging body according to claim 2, wherein the heat source means extends ring-shaped over the approximately centrally arranged condensate collector means.

5. A heat-exchanging body according to claim 2, wherein the heat source means extends meander-shaped over the approximately centrally arranged condensate collector means.

6. A heat-exchangin body according to claim 1, wherein the condensate collector means is constructed as a ring channel.

7. A heat-exchanging body according to claim 2, wherein the condensate collector means is constructed as an intersecting channel system.

8. A heat-exchanging body according to claim 2, wherein the condensate collector means is constructed as a disk-shaped hollow space.

9. A heat-exchanging body according to claim 1 constructed as an inflated multi-layer partial composite laminated body.

10. A heat-exchanging body according to claim 1 further comprising means for mounting the heat pipe-channel system disposed as a horizontal installation in a vehicle.

11. A plate-shaped heater for the horizontal installation and use in a vehicle wherein the heater is developed as a multilayer inflated partially laminated piece, containing a hermetically sealed, connected heat pipe channel system extending over the surface of the plate-shaped heater, said heat pipe channel system being formed by crossing channels which extend at least in two directions at angles with respect to one another to a center and an outer edge respectively and are connected with one another, the heat pipe channel system containing a condensate collector channel contiguous only to one of said center and outer edge and into which the crossing channels lead, the condensate collector channel being connected at least approximately over its whole length in a heat-conducting manner with a heat source extending correspondingly at least approximately along the whole course of the condensate collector channel.

12. A heat-exchanging body according to claim 11 comprising means for mounting the heat pipe-channel system as a horizontal installation in a vehicle.

13. A heat-exchanging body according to claim 11, wherein the heat-exchanging body is curved and is arranged substantially horizontally in the normally installed position in such a manner that the condensate collector means comes to lie geometrically at the lowest place.

14. A heat-exchanging body according to claim 13, wherein the heat-exchanging body is curved hourglass-shaped.

15. A heat-exchanging body according to claim 13, wherein the heat-exchanging body is curved slightly conically shaped.

16. A heat-exchanging body according to claim 13, wherein the heat-exchanging body is curved slightly pyramidally shaped.

17. A heat-exchanging body according to claim 13, constructed as an inflated multi-layer partial composite laminated body.

18. A heat-exchanging body according to claim 13, wherein the condensate collector means is arranged approximately centrally within the heat-exchanging body, in that the channel means of the heat pipe channel system extend star-shaped away from the condensate collector means in all directions and in that the heat source means extends over the approximately centrally arranged condensate collector means.

* * * * *